United States Patent [19]

Gilson et al.

[11] Patent Number: 4,983,497

[45] Date of Patent: Jan. 8, 1991

[54] TREATED ANODIZED ALUMINUM SUPPORT AND LITHOGRAPHIC PRINTING PLATE CONTAINING SAME

[75] Inventors: Richard E. Gilson, Rochester, N.Y.; Gary R. Miller, Fort Collins, Colo.

[73] Assignee: Eastman Kodak Company, Rochester, N.Y.

[21] Appl. No.: 38,436

[22] Filed: Apr. 13, 1987

Related U.S. Application Data

[63] Continuation of Ser. No. 786,403, Oct. 10, 1985, abandoned.

[51] Int. Cl.[5] ..... B41N 1/08

[52] U.S. Cl. ..... 430/272; 430/278; 430/279; 428/448; 428/450; 101/459

[58] Field of Search ..... 430/272, 278, 279; 428/448, 450; 101/459

[56] References Cited

U.S. PATENT DOCUMENTS

| | | | |
|---|---|---|---|
| 2,714,066 | 7/1955 | Jewett et al. | 95/8 |
| 3,181,461 | 5/1965 | Fromson | 101/149.2 |
| 3,374,155 | 3/1968 | Weber | 204/38 |
| 3,860,426 | 1/1975 | Cunningham et al. | 96/86 |
| 3,902,976 | 9/1975 | Walls | 204/38 |
| 4,116,695 | 9/1978 | Mori et al. | 96/86 |
| 4,225,398 | 9/1980 | Hasegawa et al. | 204/33 |
| 4,230,492 | 10/1980 | Thomas | 430/302 |
| 4,284,710 | 8/1981 | Burg | 430/286 |
| 4,301,229 | 11/1981 | Sakaki | 430/302 |
| 4,467,028 | 8/1984 | Huang | 430/302 |
| 4,492,616 | 1/1985 | Pliefke et al. | 204/33 |
| 4,499,170 | 2/1985 | Amariti | 430/175 |
| 4,561,944 | 12/1985 | Sasaki | 204/129.4 |

*Primary Examiner*—Clifford D. Crowder
*Attorney, Agent, or Firm*—J. Jeffrey Hawley

[57] ABSTRACT

A lithographic printing plate support material comprising an anodized aluminum plate having an anodic layer, a silicate layer in contact with the anodic layer, and a metal salt layer, in contact with the silicate layer, which comprises a metal salt having the formula MX wherein M is a metal selected from the group consisting of zinc, magnesium, nickel, and chromium, and X is an anion selected from the group consisting of acetate, chloride, and borate. A method for preparing the support material comprises the steps of contacting an anodized aluminum plate with a silicating agent and contacting the silicated plate with the above-described metal salt. Lithographic printing plates comprising the above-described support material and a radiation-sensitive layer exhibit improved press sensitivity and extended shelf-life.

7 Claims, No Drawings

TREATED ANODIZED ALUMINUM SUPPORT AND LITHOGRAPHIC PRINTING PLATE CONTAINING SAME

This is a continuation of application Ser. No. 786,403, filed Oct. 10, 1985, now abandoned.

CROSS REFERENCE TO RELATED APPLICATIONS

Reference is hereby made to commonly-assigned copending U.S. patent applications Ser. No. 786,012, now U.S. Pat. No. 4,647,346 issued Mar. 3, 1987 entitled ANODIZED ALUMINUM SUPPORT, METHOD FOR THE PREPARATION THEREOF, AND LITHOGRAPHIC PRINTING PLATE CONTAINING SAME filed in the names of G. R. Miller and R. E. Gilson concurrently herewith and Ser. No. 786,013, now U.S. Pat. No. 4,640,886 issued Feb. 3, 1987 entitled SUBBED LITHOGRAPHIC PRINTING PLATE filed in the names of G. R. Miller and R. E. Gilson concurrently herewith.

BACKGROUND OF THE INVENTION

1. Field of the Invention

This invention relates to a support material for use in a lithographic printing plate, to a method for the preparation of the support material, and to a lithographic printing plate comprising such support material exhibiting improved press sensitivity and extended shelf-life.

2. Description of the Prior Art

One important characteristic of any presensitized lithographic printing plate is the ability to remain stable and yield reproducible photographic speed performance between the time the plate is manufactured and subsequently used. Yet another important property is the ability of the plate to shed ink from non-image areas during start-up and throughout the useful life of the plate.

U.S. Pat. No. 4,492,616 describes a process for treating aluminum oxide layers by treating the metal surface with an aqueous alkali metal silicate solution and an aqueous solution containing alkaline earth metal ions.

U.S. Pat. No. 3,860,426 describes a lithographic printing plate having a hydrophilic cellulosic subbing layer containing a water-soluble salt of a metal to reduce scumming of the plate in areas in which the printing layer is removed. While these plates have gained widespread commercial acceptance, they have not been found to yield reproducible speed performance between the time the plate is manufactured and used under all storage and handling conditions encountered. Moreover, the printing industry has demanded more stringent requirements regarding press sensitivity in their efforts to minimize variability and waste.

Thus, there is a need for lithographic printing plates exhibiting improved press sensitivity and extended shelf-life.

SUMMARY OF THE INVENTION

In accordance with the present invention, there is provided a lithographic printing plate exhibiting improved press sensitivity performance and extended shelf-life.

The invention provides a lithographic printing plate support material comprising an anodized aluminum plate having an anodic layer, a silicate layer in contact with the anodic layer, and a metal salt layer, in contact with the silicate layer, which comprises a metal salt having the formula MX, wherein M is a metal selected from the group consisting of zinc, magnesium, nickel and chromium and X is an anion selected from the group consisting of acetate, chloride and borate.

The invention further provides a method for preparing a lithographic printing plate support material comprising the steps of (a) contacting an anodized aluminum plate with a silicate and (b) contacting the silicated plate with a metal salt having the formula MX, wherein M is a metal selected from the group consisting of zinc, magnesium, nickel and chromium and X is an anion selected from the group consisting of acetate, chloride and borate.

A lithographic printing plate in accordance with the present invention comprises (a) a lithographic printing plate support material comprising an anodized aluminum plate having an anodic layer, a silicate layer in contact with the anodic layer, and a metal salt layer, in contact with the silicate layer, which comprises a metal salt having the formula MX wherein M is a metal selected from the group consisting of zinc, magnesium, nickel, and chromium and X is an anion selected from the group consisting of acetate, chloride, and borate, and (b) a radiation sensitive layer. The lithographic printing plate of this invention exhibits improved press sensitivity performance and extended shelf-life.

DESCRIPTION OF THE PREFERRED EMBODIMENTS

The support material comprises an aluminum or aluminum alloy plate. Suitable aluminum alloys are alloys with zinc, silicon, chromium, copper, manganese, magnesium, lead, bismuth, nickel, iron or titanium which may contain negligible amounts of impurities.

The surface of the aluminum plate is preferably subjected to chemical cleaning such as degreasing with solvents or alkaline agents for the purpose of exposing a clean surface free of grease, rust or dust which is usually present on the aluminum surface. Preferably, the surface is grained. Suitable graining methods include glass bead graining, ball graining, sand blasting, brush graining and electrolytic graining. Following the graining operation, the support can be treated with an aluminum etching agent and a desmutting acid bath.

An anodized stratum is then formed on the aluminum plate. This stratum is referred to herein as an anodic layer. An electric current is passed through the support immersed as a cathode in a solution containing one or more acids selected from phosphoric acid, sulfuric acid, oxalic acid, boric acid, chromic acid, sulfamic acid, and benzenesulfonic acid. An anodized stratum is thus formed on the surface of the support. In a preferred embodiment of this invention, the support comprises an anodized aluminum stratum consisting essentially of oxides and phosphates of aluminum as described in our copending U.S. application Ser. No. 786,012, now U.S. Pat. No. 4,647,346 entitled ANODIZED ALUMINUM SUPPORT, METHOD FOR THE PREPARATION THEREOF AND LITHOGRAPHIC PRINTING PLATE CONTAINING SAME, hereby incorporated by reference in its entirety.

After anodizing, the surface of the anodized aluminum plate is contacted with a silicating agent such as an alkali metal silicate, calcium silicate, silicic acid, colloidal silica or polymerized silicic acid to silicate the plate. The silicate treatment renders the anodized surface hydrophilic. Preferably, the support is treated with an aqueous solution of the silicating agent. The silicating agent preferably is present at a concentration of about 0.5 to about 10% and the temperature of the solution preferably is 20° C. to 100° C., most preferably 60° C. to 100° C. The optimum dwell time of the plate in the solution depends on the solution temperature, the silicating agent concentration and the ultimate intended use of the lithographic plate. A dwell time of 15 to 80 seconds has been found to be particularly advantageous.

After the plate is silicated, the silicated plate is contacted with a metal salt having the formula MX wherein M is a metal selected from the group consisting of zinc, magnesium, nickel, and chromium and X is an anion selected from the group consisting of acetate, chloride, and borate. A thin treatment or layer, probably often substantially of monomolecular thickness of the metal salt is thus provided. In some instances, it is believed that metal salt molecules are deposited upon the surface non-uniformly. The layer is present in a coverage from 10 to 50 mg/m$^2$, preferably from 20 to 40 mg/m$^2$. The metal salts which are particularly useful include water soluble salts of zinc, magnesium, nickel, and chromium. The salts are formed by methods known in the art. Useful salts include acetate, chloride, and borate. The support preferably is immersed in an aqueous bath containing the metal salt at a concentration of from 0.1% to 45%, the higher concentration being limited only by the solubility of the metal salt. A preferred metal salt bath concentration is 1% to 10%, most preferably 2% to 5%. The metal salt layer can consist essentially of the above-described metal salt. The bath can be operated from room temperature to boiling; however, a temperature of 32° C.-82° C. is preferable. Excellent results have been achieved with a bath temperature of 49° C.-71° C. The dwell time of the plate in the bath depends on concentration and temperature. A dwell time of 10 seconds to 5 minutes has been found acceptable under many conditions. Preferably, the dwell time is 15 seconds to 3 minutes such that the treatment is conducive to a continuous process.

The lithographic printing plate support material of this invention can be coated, if desired, with a thin coating of a hydrophilic material which serves as a subbing layer. The hydrophilic coating contributes to improving the water receptivily of the non-printing areas of the processed plate. Preferably, the hydrophilic coating is coated over a support treated as described above. The hydrophilic coating is coated by known techniques in a subbing amount. It is particularly advantageous to use a water-soluble permanently hydrophilic material which can be coated from an aqueous dispersion. A solution containing polyacrylamide is especially advantageous for this purpose, as are solutions containing carboxymethyl cellulose, polyvinylphosphonic acid, sodium silicate and combinations of these. Other polymers useful in forming hydrophilic interlayers include polyvinylalcohol, copolymers of maleic anhydride with ethylene, vinyl acetate, styrene or vinyl methyl ether, polyacrylic acid, hydroxymethyl cellulose and polyvinyl pyrrolidone.

In a preferred embodiment of this invention, the lithographic printing plate support material of this invention is coated with a hydrophilic coating as described in our above-noted copending U.S. patent application Ser. No. 786,013 entitled SUBBED LITHOGRAPHIC PRINTING PLATE, hereby incorporated by reference in its entirety. Thus, the hydrophilic layer can comprise benzoic acid, carboxymethyl cellulose, and optionally, sodium molybdate and a surfactant.

The lithographic printing plate in accordance with this invention comprises (a) a lithographic printing plate support material comprising an anodized aluminum plate having an anodic layer, a silicate layer in contact with the anodic layer, and a metal salt layer, in contact with the silicate layer, which comprises a metal salt having the formula MX wherein M is a metal selected from the group consisting of zinc, magnesium, nickel, and chromium and X is an anion selected from the group consisting of acetate, chloride, and borate, and (b) a radiation sensitive layer. After the metal salt coating has dried, a radiation sensitive coating can be placed on the surface. The radiation sensitive coating is placed directly on the lithographic printing plate support material, or preferably, over one or more subbing layers. Various radiation sensitive materials suitable for forming images for use in the lithographic printing process can be used. Almost any radiation sensitive layer is suitable which after exposure, if necessary followed by developing and/or fixing, provides an area in imagewise distribution which may be used for printing.

Radiation sensitive materials useful in this invention are well known in the art, and include silver halide emulsions, as described in Research Disclosure, publication 17643, paragraph XXV, December, 1978 and references noted therein; quinone diazides (polymeric and non-polymeric), as described in U.S. Pat. No. 4,141,733 (issued Feb. 27, 1979 to Guild) and references noted therein; light sensitive polycarbonates, as described in U.S. Pat. No. 3,511,611 (issued May 12, 1970 to Rauner et al) and references noted therein; diazonium salts, diazo resins, cinnamal-malonic acids and functional equivalents thereof and others described in U.S. Pat. No. 3,342,601 (issued Sept. 19, 1967 to Houle et al) and references noted therein; and light sensitive polyesters, polycarbonates and polysulfonates, as described in U.S. Pat. No. 4,139,390 (issued Feb. 13, 1979 to Rauner et al) and references noted therein.

Particularly useful radiation sensitive materials are photocrosslinkable polymers, such as polyesters, containing the photosensitive group

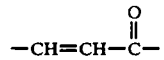

as an integral part of the polymer backbone. For example, preferred photocrosslinkable polymers are polyesters prepared from one or more compounds represented by the following formulae:

(A)

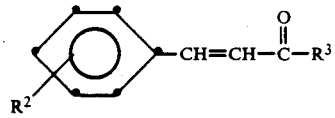

wherein $R^2$ is one or more alkyl of 1 to 6 carbon atoms, aryl of 6 to 12 carbon atoms, aralkyl of 7 to 20 carbon atoms, alkoxy of 1 to 6 carbon atoms, nitro, amino, acrylic, carboxyl, hydrogen or halo and is chosen to provide at least one condensation site; and $R^3$ is hydroxy, alkoxy of 1 to 6 carbon atoms, halo or oxy if the compound is an acid anhydride. A preferred compound is p-phenylene diacrylic acid or a functional equivalent thereof. These and other useful compounds are described in U.S. Pat. No. 3,030,208 (issued Apr. 17, 1962 to Schellenberg et al); U.S. Pat. No. 3,702,765 (issued Nov. 14, 1972) to Laakso); and U.S. Pat. No. 3,622,320 (issued Nov. 23, 1971 to Allen), the disclosures of which are incorporated herein by reference.

(B)

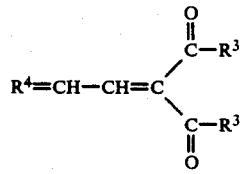

$R^3$ is as defined above, and $R^4$ is alkylidene of 1 to 4 carbon atoms, aralkylidene of 7 to 16 carbon atoms, or a 5- to 6-membered heterocyclic ring. Particularly useful compounds of formula (B) are cinnamylidenemalonic acid, 2-butenylidenemalonic acid, 3-pentenylidenemalonic acid, 0-nitrocinnamylidenemalonic acid, naphthyallylidenemalonic acid, 2-furfurylideneethylidenemalonic acid and functional equivalents thereof. These and other useful compounds are described in U.S. Pat. No. 3,674,745 (issued Jul. 4, 1972 to Philipot et al), the disclosure of which is incorporated herein by reference.

(C)

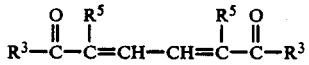

$R^3$ is as defined above; and $R^5$ is hydrogen or methyl. Particularly useful compounds of formula (C) are trans, trans-muconic acid, cis, transmuconic acid, cis, cis-muconic acid, $\alpha$, $\alpha'$-cis, trans-dimethylmuconic acid, $\alpha$, $\alpha'$-cis, cis-dimethylmuconic acid and functional equivalents thereof. These and other useful compounds are described in U.S. Pat. No. 3,615,434 (issued Oct. 26, 1971 to McConkey), the disclosure of which is incorporated herein by reference.

(D)

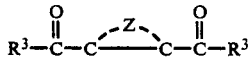

$R^3$ is as defined above; and Z represents the atoms necessary to form an unsaturated, bridged or unbridged carbocyclic nucleus of 6 or 7 carbon atoms. Such nucleus can be substituted or unsubstituted. Particularly useful compounds of formula (D) are 4-cyclohexene-1,2-dicarboxylic acid, 5-norbornene-2,3-dicarboxylic acid, hexachloro-5[2:2:1]-bicycloheptene-2,3-dicarboxylic acid and functional equivalents thereof. These and other useful compounds are described in Canadian Patent No. 824,096 (issued Sept. 30, 1969 to Mench et al), the disclosure of which is incorporated herein by reference.

(E)

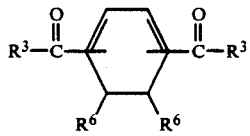

$R^3$ is as defined above; and $R^6$ is hydrogen, alkyl of 1 to 12 carbon atoms, cycloalkyl of 5 to 12 carbon atoms or aryl of 6 to 12 carbon atoms. $R^6$ can be substituted, where possible, with such substituents as do not interfere with the condensation reaction, such as halo, nitro, aryl, alkoxy, aryloxy, etc. The carbonyl groups are attached to the cyclohexadiene nucleus meta or para to each other, and preferably para. Particularly useful compounds of formula (E) are 1,3-cyclohexadiene-1,4-dicarboxylic acid, 1,3-cyclohexadiene-1,3-dicarboxylic acid, 1,5-cyclohexadiene-1,4-dicarboxylic acid and functional equivalents thereof. These and other useful compounds are described in Belgian Patent No. 754,892 (issued Oct. 15, 1970), the disclosure of which is incorporated herein by reference.

The radiation-sensitive coating can be prepared by dispersing the radiation sensitive composition or polymer in any suitable solvent or combination of solvents used in the art.

Radiation-sensitivity can be stimulated in the coating composition by incorporating therein a sensitizer. Suitable sensitizers include anthrones, such as 1-carbethoxy-2-keto-3-methyl-2-azabenzanthrone, benzanthrone; nitro sensitizers; triphenylmethanes; quinones; cyanine dye sensitizers; naphthone sensitizers such as 6-methoxybeta-2-furyl-2-acrylonaphthone; pyrylium or thiapyrylium salts, such as 2,6-bis(p-ethoxy-phenyl)-4-(p-n-amyloxyphenyl)-thiapyrylium perchlorate and 1,3,5-triphenylpyrylium fluoroborate; furanone; 4-picoline-N-oxide; anthraquinones such as 2-chloroanthraquinone; thiazoles such as 2-benzoylcarbethoxymethylene-1-methyl-betanaphthothiazole and methyl 2-(n-methylbenzothiazolylidene) dithioacetate; methyl 3-methyl-2-benzothiazolidene dithioacetate; thiazolines such as 3-ethyl-2-benzoylmethylene-naptho[1,2-d]-thiazoline, benzothiazoline, (2-benzoylmethylene)-1-methyl-beta-naphthothiazoline; 1,2-dihydro-1-ethyl-2-phenacylidenenaphtho[1,2-d]-thiazole; and naphthothiazoline; quinolizones, Michler's ketone; and Michler's thioketone.

In addition to the sensitizers, a number of other addenda can be present in the coating composition and ultimately form a part of the lithographic plate. For example, dyes or pigments may be included to obtain colored images to aid in recognition. Other components which can be advantageously included in the coating composition are materials which serve to improve film formation, coating properties, adhesion of the coatings to the support, mechanical strength and stability.

The lithographic printing plate of the present invention can be exposed by conventional methods, for example through a transparency or a stencil, to an imagewise pattern of actinic radiation. Suitable radiation sources include carbon arc lamps, mercury vapor lamps, fluorescent lamps, tungsten filament lamps, photoflood lamps, lasers and the like.

The exposed lithographic printing plate can be developed using conventional developer and developing techniques. For example, in developing the lithographic printing plates incorporating radiation-sensitive polyesters noted above, the developer composition is applied to the surface of the plate for a period of time sufficient to remove the polymer from non-image areas of the plate. Gentle mechanical action aids in removing the polymer composition from these areas. Thus, swabbing is a useful method of applying the developer composition to the plate. The developer composition is typically used at room temperature but it can be employed at elevated temperatures up to about 32° C. After the initial application of the developer composition, a second application can be applied, followed by either a single or double application of a desensitizing composition. The plate is then dried.

The following examples further illustrate the invention:

EXAMPLE 1 AND COMPARATIVE EXAMPLES A–B

An aluminum plate was immersed in a caustic solution to remove oil and dirt from the surface. The surface was grained with a brush and a slurry of abrasive media. Loose residue was removed by etching in a caustic solution followed by a nitric acid desmutting bath.

The aluminum plate was anodized in a phosphoric acid electrolyte under the conditions described in our copending U.S. application Ser. No. 786,012, entitled ANODIZED ALUMINUM SUPPORT, METHOD FOR THE PREPARATION THEREOF AND LITHOGRAPHIC PRINTING PLATE CONTAINING SAME.

The plate of Comparative Example A was coated with a thin layer of polyacrylamide at a coverage of 14 $mg/m^2$. The plate was coated with a radiation sensitive coating as described in U.S. Pat. No. 3,030,208, a condensation product of hydroxy ethoxy cyclohexane and p-phenylenediethoxy acrylate.

The plate of Comparative Example B was prepared and anodized as described above. The anodized support was treated in a 2% solution of PQ-D sodium silicate sold by PQ Corporation. The $SiO_2$ to $Na_2O$ ratio was 2:1. The support was immersed in a bath having a temperature of 82° C. for 45 seconds. The support was rinsed, dried and coated with a polyacrylamide and a radiation sensitive layer as described above.

The plate of Example 1 was prepared and anodized as described above and treated in a 2% solution of PQ-D sodium silicate in a 86° C. bath for 30 seconds. The plate was immersed in an aqueous bath containing 2% zinc acetate for 30 seconds. The bath temperature was 65° C. The support was rinsed, dried and coated with a polyacrylamide and a radiation sensitive layer as described above.

The dried plates were contacted to a film original including a step tablet having 14 gradations and exposed to a radiation source rich in UV radiation. The exposed plates were processed with a negative developer, treated with a lithographic plate finisher and dried. The developer and finisher are described in Examples 1–8 of U.S. Pat. No. 4,419,437.

The press sensitivity and shelf-life of the plates were determined as follows: The shelf-life of the plates was determined by measuring the Log E speed shift of the coated plate using the step tablet after a 2-week incubation period at 49° C. as compared to the speed of a fresh non-incubated plate. The press sensitivity test measures the rate at which a plate sheds ink from the non-image areas and involves mounting the plate on a printing press. The press is started such that the plate receives an overall ink charge to both the image and non-image areas, i.e., the dampening system is not applied. The dampening system thereafter is applied, and prints are made as the ink sheds from the non-image areas. This procedure is repeated for ten 5-minute holds. The results reported are calculated from a final one-hour eleventh hold and are determined from background ink density measurments taken from the first twenty sheets. The results are reported as a comparison to the performance of commercially available Kodak Polymatic TM Litho Plates.

| Example | Incubated Log E Speed Change | Press Sensitivity |
|---|---|---|
| 1 | .13 | excellent |
| A | .09 | adequate |
| B | — | excellent |

Comparative Example B demonstrated a dramatic improvement in press sensitivity as compared to the unsilicated plate of Comparative Example A. The non-exposed radiation sensitive layer of Comparative Example B, however, could not be removed by the developer indicating insolubilization of the layer due to a reaction with the silicate present on the support, rendering the plate unusable.

Example 1 of this invention indicates that a plate subjected to the treatment of this invention exhibits improved press sensitivity and excellent plate stability.

EXAMPLES 2–3

Effect of Bath Temperature

Plates were prepared and tested as in Example 1, except that the temperature of the zinc acetate bath was as follows:

| Example | T (°C.) | Incubated Log E Speed Change | Press Sensitivity |
|---|---|---|---|
| 2 | 21° C. | 0.44 | excellent |
| 3 | 38° C. | 0.31 | excellent |

The results indicate improving stability as the bath temperature is raised.

EXAMPLES 4–8

Effect of Bath Concentration

Plates were prepared and tested as in Example 1, except that the plates were immersed for 25 seconds in a 49° C. bath and the concentration of the zinc acetate bath was varied as follows.

| Example | Concentration % | Incubated Log E Speed Change | Press Sensitivity |
|---|---|---|---|
| 4 | 0.5 | 0.40 | excellent |
| 5 | 1.0 | 0.14 | excellent |
| 6 | 2.0 | 0.07 | excellent |
| 7 | 3.0 | 0.09 | excellent |
| 8 | 5.0 | 0.17 | excellent |

The results indicate that incubation stability reaches a maximum at a bath concentration of about 2%.

EXAMPLES 9–16

Effect of Bath Component

Plates were prepared and tested as in Example 1 except that the following bath components were evaluated at the following concentrations, bath temperatures and plate dwell times.

| Example | Component | Concentration | Bath Temperature °C. | Dwell Time Seconds | Incubated Log E Speed Change | Press Sensitivity |
|---|---|---|---|---|---|---|
| 9 | zinc chloride | 2.0 | 66° C. | 30 | 0.55 | excellent |
| 10 | zinc chloride | 2.0 | 21° C. | 30 | — | excellent |
| 11 | zinc chloride | 2.0 | 38° C. | 30 | — | excellent |
| 12 | zinc borate | 2.0 | 66° C. | 30 | 0.12 | excellent |
| 13 | magnesium acetate | 3.0 | 54° C. | 15 | 0.37 | excellent |
| 14 | nickel acetate | 3.0 | 54° C. | 15 | 0.40 | excellent |
| 15 | chromium acetate | 3.0 | 54° C. | 15 | 0.27 | excellent |
| 16 | zinc acetate | 3.0 | 54° C. | 15 | 0.05 | excellent |

The non-exposed radiation sensitive layer of Examples 10 and 11 could not be removed by the developer. The results indicate that zinc chloride requires a higher bath temperature than does zinc acetate to effect stabilization, and that zinc acetate is the preferred salt in view of its excellent performance as an agent which improves plate stability.

EXAMPLE 17

Effect of Radiation Sensitive Layer

A plate was prepared as described in Example 1, except that the radiation sensitive composition was a positive working copolymer of alkyl acrylate, acryloyloxyalkyl quinone diazide acid ester and acryloyloxyalkyl carboxylate repeating units, as described in U.S. Pat. No. 3,859,099. The silicated plate was contacted with a 3.0% zinc acetate bath at 60° C. for 28 seconds. The plate of this Example was suitably exposed and processed using a suitable lithographic developer and finisher. An acceptable printing plate was provided by this process.

A plate prepared in accordance with this Example but not silicated was not acceptable. A silicated plate prepared in accordance with this Example but not subjected to a zinc acetate treatment was unusable under some handling conditions.

EXAMPLE 18

Effect of Anodizing Electrolyte

An aluminum plate supplied by Anocoil Corporation was wire brush grained and anodized in a sulfuric acid electrolyte. A diazo resin sold by Western as Western Wipe-on resin was coated on the anodized plate to provide 75 mg/m$^2$ resin coverage. The solution was coated out of water. Olin 10G surfactant was used as a coating aid. The resulting plate was exposed to a metal halide light source through a step tablet having 14 gradations. The exposed plate was processed using tap water. To provide a visible image, the plate was hand inked with rub-up ink, rinsed and dried. The plate gained speed after incubation indicating instability.

An aluminum plate anodized as described above was silicated by immersion in a solution of sodium silicate as in Comparative Example B. The plate was coated, exposed and processed as described in this Example above. This plate was not processable after incubation, indicating very poor stability of the diazo resin coating.

An Anocoil aluminum plate was prepared as described above, except the silicating step was followed by treatment in a zinc acetate solution as in Example 1. This plate processed cleanly before and after incubation with only a slight speed gain after incubation, indicating a very stable plate.

Although the invention has been described in considerable detail with particular reference to certain preferred embodiments thereof, variations and modifications can be effected within the spirit and scope of the invention.

What is claimed is:

1. A lithographic printing plate support material comprising an anodized aluminum plate having an anodic layer, a silicate layer in contact with the anodic layer, and a zinc acetate layer, in contact with the silicate layer, formed by treating the silicate layer with an aqueous bath consisting essentially of a solution of zinc acetate.

2. A lithographic printing plate comprising:

(a) a lithographic printing plate support material comprising an anodized aluminum plate having an anodic layer, a silicate layer in contact with the anodic layer, and a zinc acetate layer, in contact with the silicate layer, formed by treating the silicate layer with an aqueous bath consisting essentially of a solution of zinc acetate, and (b) a radiation sensitive layer.

3. The plate of claim 2 further comprising a hydrophilic subbing layer between the zinc acetate layer and the radiation sensitive layer.

4. The plate of claim 2 wherein said zinc acetate layer is present in a coverage of from 10 to 50 mg/m$^2$.

5. The plate of claim 2 wherein said aqueous bath contains said zinc acetate at a concentration of 1 to 10 percent.

6. The plate of claim 2 wherein the temperature of said aqueous bath is in a range of from 49° C. to 71° C.

7. The plate of claim 2 wherein the duration of treatment with said aqueous bath is from 15 second to 3 minutes.

* * * * *